United States Patent [19]

Yoshimura et al.

[11] Patent Number: 5,066,553

[45] Date of Patent: Nov. 19, 1991

[54] SURFACE-COATED TOOL MEMBER OF TUNGSTEN CARBIDE BASED CEMENTED CARBIDE

[75] Inventors: Hironori Yoshimura; Yoshihiro Sawada; Kei Nakahara; Hitoshi Kunugi; Keiichi Sakurai, all of Tokyo, Japan

[73] Assignee: Mitsubishi Metal Corporation, Tokyo, Japan

[21] Appl. No.: 507,665

[22] Filed: Apr. 10, 1990

[30] Foreign Application Priority Data

| | | | |
|---|---|---|---|
| Apr. 12, 1989 | [JP] | Japan | 1-92184 |
| Jun. 14, 1989 | [JP] | Japan | 1-150923 |
| Aug. 24, 1989 | [JP] | Japan | 1-220047 |
| Dec. 15, 1989 | [JP] | Japan | 1-325558 |

[51] Int. Cl.[5] ..... B32B 15/04

[52] U.S. Cl. ..... 428/698; 511/307; 511/309; 76/DIG. 11; 407/119; 428/212; 428/336; 428/408; 428/469; 428/699

[58] Field of Search ..... 428/408, 457, 469, 698, 428/697, 699, 212, 336; 51/307, 309; 407/119; 76/DIG. 11

[56] References Cited

U.S. PATENT DOCUMENTS

| | | | |
|---|---|---|---|
| 4,194,790 | 3/1980 | Kenny et al. | 51/309 |
| 4,359,335 | 11/1982 | Garner | 428/698 |
| 4,401,719 | 8/1983 | Kobayashi et al. | 428/698 |
| 4,488,882 | 12/1984 | Dausinger et al. | 51/309 |
| 4,610,931 | 9/1986 | Nemeth et al. | 428/547 |
| 4,649,084 | 3/1987 | Hale et al. | 428/552 |
| 4,698,266 | 10/1987 | Buljan et al. | 428/698 |
| 4,705,124 | 11/1987 | Abrahamson et al. | 76/DIG. 11 |
| 4,731,296 | 3/1988 | Kikuchi et al. | 428/408 |
| 4,743,515 | 5/1988 | Fischer et al. | 428/698 |
| 4,776,863 | 10/1988 | van den Berg et al. | 51/295 |
| 4,812,370 | 3/1989 | Okada et al. | 428/552 |

FOREIGN PATENT DOCUMENTS

| | | |
|---|---|---|
| 52-110209 | 9/1977 | Japan . |
| 54-87719 | 7/1979 | Japan . |
| 5083517 | 6/1980 | Japan . |
| 61-52541 | 11/1981 | Japan . |
| 719259 | 11/1982 | Japan . |
| 0025605 | 2/1985 | Japan . |
| 2196371 | 8/1987 | Japan . |
| 1183310 | 7/1989 | Japan . |

OTHER PUBLICATIONS

European Search Report, Application No. 90 106 963.3 and Annex.

*Primary Examiner*—Ellis P. Robinson
*Assistant Examiner*—Archene A. Turner
*Attorney, Agent, or Firm*—Scully, Scott, Murphy & Presser

[57] ABSTRACT

There is disclosed a surface-coated tool member of tungsten carbide based cemented carbide which has a tungsten carbide based cemented carbide substrate and a hard coating formed on the substrate. The hard coating may have one or more layers each of which is made of one material selected from the group consisting of carbide, nitride and oxide of metals in groups $IV_A$, $V_A$ and $VI_A$ of the Periodic Table; solid solution of said carbide, nitride and oxide; and aluminum oxide. The cobalt content of the substrate in a surface portion at a depth of about 2 μm from a surface thereof is less than that in an interior portion at a depth of about 100 μm from said surface by at least 10%.

6 Claims, 2 Drawing Sheets

SURFACE-COATED TOOL MEMBER OF TUNGSTEN CARBIDE BASED CEMENTED CARBIDE

BACKGROUND OF THE INVENTION

1. Field of the Invention

The present invention relates to surface-coated tool members of tungsten carbide (WC) based cemented carbide which have hard coatings less susceptible to separation and have superior resistance to wearing and chipping when used as cutting tools for milling or finish turning operations.

2. Prior Art

There is known a surface-coated tool member, which comprises a WC-based cemented carbide substrate and a hard coating formed thereon and comprising one or more layers each composed of one of carbides, nitrides and oxides of metals in groups IVA, VA and VIA of the Periodic Table, solid solutions of these compounds and aluminum oxide.

For example, Japanese Patent Application Laid-Open (18-Month Publication) No. 52-110209 describes a surface-coated WC-based cemented carbide tool member in which the hardness at a portion of the substrate near the surface thereof is reduced 2% to 20% compared with that at a interior portion of the substrate by modifying cobalt (Co) content, titanium carbide (TiC) content and grain size of WC.

Another surface-coated tool member disclosed in Japanese Patent Application Laid-Open No. 54-87719 comprises a soft layer which is formed near the surface of the substrate by subjecting WC-based cemented carbide containing nitrogen to sintering in a vacuum. U.S. Pat. No. 4,610,931 describes a similar tool member.

In each of these tool members, the cobalt content at the portion near the surface of the substrate is more than that at the interior portion thereof, and hence even though the hard coating is subjected to cracking, the cracks are prevented from propagating in the substrate by the tough surface portion containing great cobalt content. Therefore, the tool members exhibit excellent performance particularly in a rough turning operation for steel or cast iron.

However, although the aforesaid tool members are less susceptible to chipping due to their great toughness, the bonding strength between the hard coating and the substrate is not sufficient, and hence the hard coating is susceptible to separation, resulting in abnormal wearing. Accordingly, when a cutting tool composed of the aforesaid prior art tool member is employed in milling operation wherein a great impact is exerted on the hard coating, or in finish turning wherein shear stress is exerted on the hard coating, the tool life is reduced unduly.

SUMMARY OF THE INVENTION

It is therefore an object of the present invention to provide a surface-coated tool member of WC-based cemented carbide which has a hard coating less susceptible to separation during milling or finish turning operations, so that it has superior resistance to wearing and chipping.

According to the present invention, there is provided a surface-coated tool member of WC-based cemented carbide having a WC-based cemented carbide substrate and a hard coating formed on the substrate, wherein cobalt content of the substrate at a surface portion at a depth of about 2 μm from a surface thereof is less than that at an interior portion at a depth of about 100 μm from the surface by at least 10%.

In the foregoing, the hard coating may comprise one or more layers each composed of one material selected from the group consisting of carbides, nitrides and oxides of metals in groups $IV_A$, $V_A$ and $VI_A$ of the Periodic Table; solid solutions of the above carbides, nitrides and oxides; and aluminum oxide. In addition, the average grain size of the WC contained at the surface portion of the substrate should preferably be greater than that of the WC contained at the interior portion by at least 10%.

DETAILED DESCRIPTION OF THE INVENTION

Figure 1:
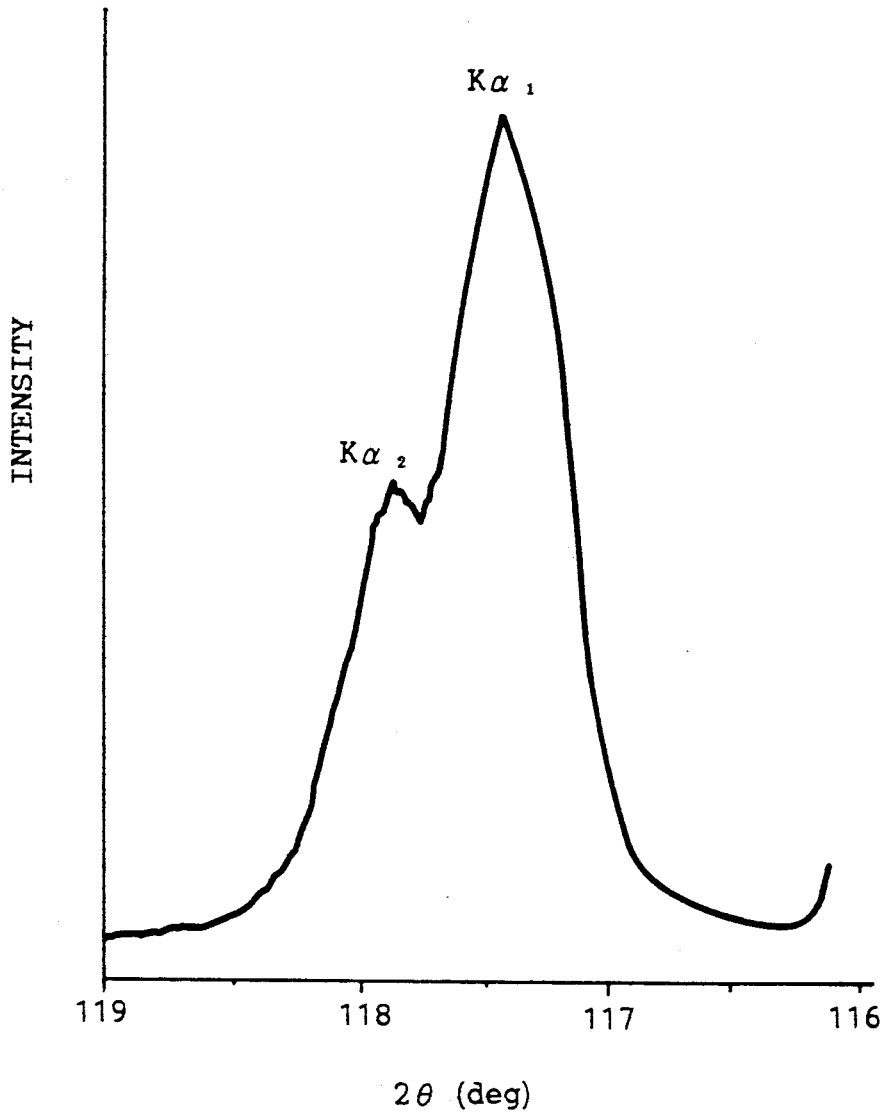
FIG. 1 is an illustration showing X-ray diffraction peaks indexed by index of plane (2, 1, 1) of WC at the portion near the surface of the substrate of a tool member in accordance with the present invention.

After an extensive study on a surface-coated tool member of WC-based cemented carbide, the inventors have come to know that when produced by grinding a usual WC-based cemented carbide with a diamond grinding wheel, heat-treating the ground cemented carbide at a temperature no less than WC-Co eutectic temperature (no less than 1,300° C.) in a vacuum or in an inert gas atmosphere, and forming a hard coating on the cemented carbide thus heat-treated, the hard coating of the resulting tool member is less susceptible to separation during milling or finish turning operations, so that the tool member has superior resistance to wearing and chipping The tool member in accordance with the present invention has been developed based on the above investigation, and is produced as follows.

A surface of a usual WC-based cemented carbide is first ground with a diamond grinding wheel. With this procedure, a great stress is imparted to WC grains near the surface of the WC-based cemented carbide, and the WC grains are partly crushed into smaller grains.

The resulting cemented carbide is then heat-treated at a temperature no less than WC-Co eutectic temperature, i.e., at no less than 1,300° C., in a vacuum, in an insert gas atmosphere at the ordinary pressure, or in a pressurized inert gas atmosphere. With this procedure, the cobalt content of the substrate at a portion near its surface decreases, and the small WC grains are recrystallized into coarse grains. In addition, the portion near the surface is well crystallized so as to exhibit two diffraction peaks $K\alpha_1$ and $K\alpha_2$ indexed by index of plane (2, 1, 1) for WC in X-ray diffraction In the aforesaid substrate, the cobalt content is extremely small at the surface portion of the substrate since the WC grains are recrystallized on the surface and become rich thereat. When a hard coating is formed on the surface of the substrate, inasmuch as the cobalt content at the surface portion of the substrate is less than that at the interior portion, cobalt is prevented from forming brittle $\eta$ phase ($W_3Co_3C$) during coating, and from diffusing in the hard coating. Therefore, the tool member thus obtained has a very high bonding strength between the coating and the substrate.

On examination of the substrate after the formation of the hard coating, it has been found that the cobalt content of the substrate at a portion near its surface decreases, and the small WC grains are recrystallized into coarse grains. In addition, the portion near the surface is well crystallized so as to exhibit two diffraction peaks $K\alpha_1$ and $K\alpha_2$ indexed by index of plane (2, 1, 1) for WC in X-ray diffraction.

In contrast, the prior art tool member is formed by grinding a surface of WC-based cemented carbide and forming a hard coating directly on the ground surface. Hence, the cobalt content of the substrate at its surface portion is not reduced, and the WC grains at the surface portion are crushed into small ones. Therefore, cobalt forms brittle $\eta$ phase easily by reacting with the crushed WC. In addition, the X-ray diffraction peaks indexed by index of plane (2, 1, 1) for WC are not separated into two peaks $K\alpha_1$ and $K\alpha_2$. In such a prior art tool member, the bonding strength between the hard coating and the substrate is low and the tool life is short.

The present invention will now be illustrated by the following example:

EXAMPLE 1

There were prepared, as starting material powders, WC powder, (W, Ti)C powder (powder of solid solution consisting of 70% by weight of WC, 30% by weight of TiC), (W, Ti, Ta)C powder (powder of solid solution consisting of 50% by weight of WC, 30% by weight of TiC and 20% by weight of TaC), (W, Ti)(C, N) powder (powder of solid solution consisting of 55% by weight of WC, 25% by weight of TiC and 20% by weight of TiN), TaC powder and cobalt powder, each of which had an average particle size of 1 to 5 $\mu$m.

These powders were blended into the compositions set forth in Table 1, and were subjected to wet mixing in a ball mill for 72 hours and dried. Then, the mixed powders were pressed under a pressure of 1 ton/cm$^2$ into green compacts. The green compacts were sintered under the conditions set forth in Table 1 into WC-based cemented carbides having the same compositions as the blended compositions. Then, the WC-based cemented carbides were formed into a shape of a cutting insert in conformity with SNGN 120412 of ISO standards wit or without grinding them under the conditions set forth in Table 1. Subsequently, WC-based cemented carbide substrates A to R set forth in Table 1 were produced with or without heat-treating the aforesaid cemented carbides under the conditions set forth in Table 1, In the foregoing, the substrates A to M are obtained by carrying out heat-treatment after the grinding of the surface, while the substrates O and Q are obtained only by subjecting the cemented carbides to the surface grinding. Furthermore, the substrates N, P and R are obtained by subjecting the cemented carbides neither to the grinding nor to the heat-treatment.

Thereafter, hard coating layers having compositions and average thicknesses set forth in Tables 2-1 to 2-4 were formed on the substrates A to R by chemical vapor deposition method, to produce WC-based cemented carbide cutting inserts 1 to 35 of the invention and comparative WC-based cemented carbide cutting inserts 1 to 11 The cutting inserts 1 to 35 of the invention are obtained by forming hard coating layers on the substrates A to M, while the comparative cutting inserts 1 to 11 are formed by forming the hard coatings on the substrates N to R.

The conditions for the chemical vapor deposition method were as follows:

(1) TiC hard coating layer:

Temperature: 1,030° C.
Pressure: 100 Torr
Composition of reaction gas: 4% by volume of $TiCl_4$–5% by volume of $CH_4$–91% by volume of $H_2$ (2) TiN hard coating layer:

Temperature: 980° C.
Pressure: 100 Torr
Composition of reaction gas: 4% by volume of $TiCl_4$–8% by volume of $N_2$–88% by volume of $H_2$ (3) TiCN hard coating layer:

Temperature: 1,000° C.
Pressure: 100 Torr
Composition of reaction gas: 4% by volume of $TiCl_4$–3% by volume of $CH_4$–4% by volume of $N_2$–89% by volume of $H_2$ (4) $Al_2O_3$ hard coating layer:

Temperature: 1,000° C.
Pressure: 100 Torr
Composition of reaction gas: 3% by volume of $AlCl_3$–5% by volume of $CO_2$–92% by volume of $H_2$ For the cutting inserts 1 to 35 of the invention and the comparative cutting inserts 1 to 11, the cobalt content of a portion at a depth of 2 um from the surface of the substrate and that of an interior portion at a depth of 100 um from the surface were measured by means of EDX. The results are set forth in Tables 2-1 t 2-4.

Furthermore, the diffraction peaks of index of plane (2, 1, 1) for tungsten carbide were also investigated by X-ray diffraction analysis. The conditions for the analysis were as follows:

Target-filter: Cu-Ni
Voltage: 40 kV
Current: 40 mA
Recording speed: 40 mm/2$\theta$(degree)

As will be seen from Tables 2-1 to 2-4, the separated to be $K\alpha_1$ and $K\alpha_2$.

Figure 2:
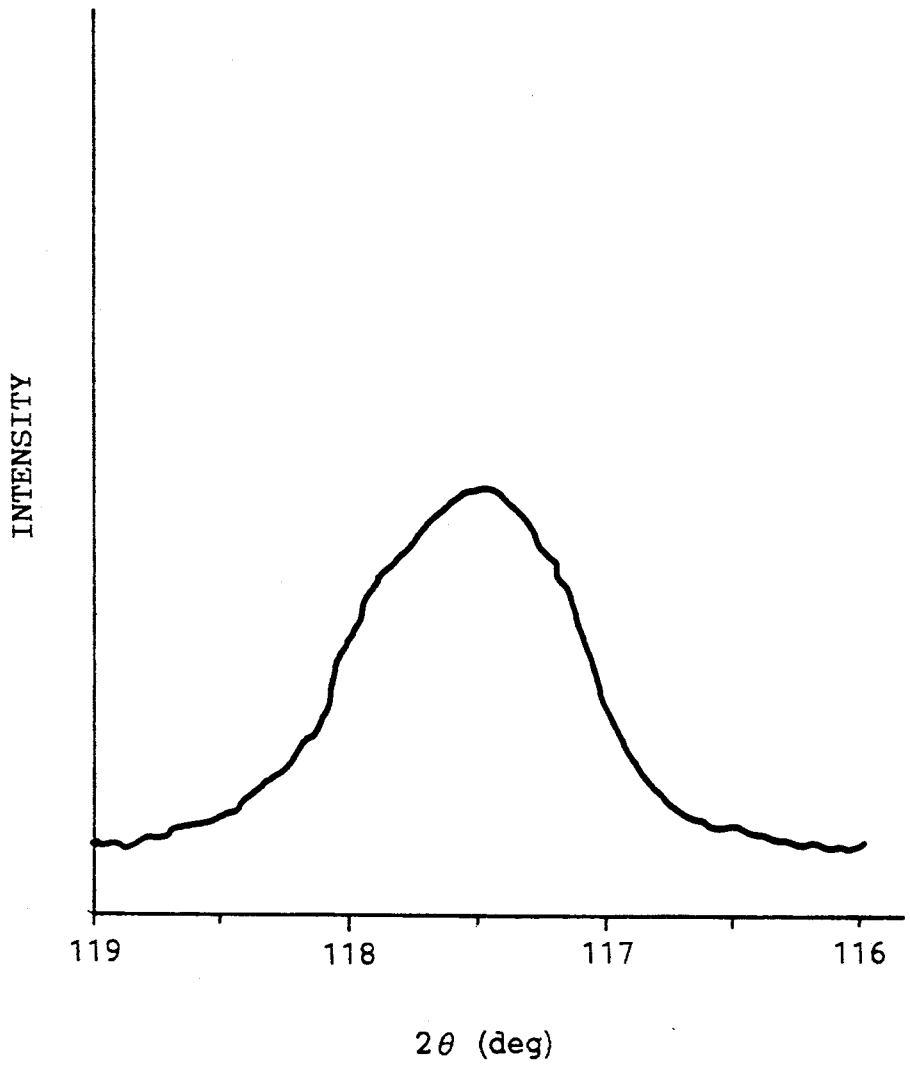
FIG.2 (PRIOR ART)
FIG. 2 is an illustration similar to FIG. 1, but showing a comparative tool member.

FIGS. 1 and 2 illustrates the diffraction patterns for both the tool member of the invention and the comparative tool member.

As will be seen from Table 1 and Tables 2-1 to 2-4, the tool member 25 of the invention and the comparative tool member 8 are similar to each other in that they are both produced by grinding the surface of WC-based cemented carbide containing 9% by weight of cobalt, 2% by weight of TaC and balance WC by diamond grinding wheel, and forming a hard coating composed of TiC (4 $\mu$m) and TiN (1 $\mu$m), while they differ from each other in whether the heat-treatment is conducted or not. In the tool member 25 of the invention, the diffraction peaks for index of plane (2, 1, 1) for WC are separated from each other as illustrated in FIG. 1, but in the comparative tool member 8, the strongest diffraction peaks of the first hard coating layer of TiC was strongly oriented at the index of plane (1, 1, 1).

The cutting inserts 1 to 35 of the invention and the comparative cutting inserts 1 to 11 were then subjected to a milling test under the following conditions:

(A) Milling test

Workpiece: Steel JIS.SNCM439 (AISI4340)(hardness HB 270)

Cutting speed: 180 m/min

Feed rate: 0.3 mm/tooth

Depth of cut: 3.0 mm

Coolant: none

Cutting time: 40 min

Then, the cutting inserts were examined for flank wear width. The results are set forth in Tables 2-1 to 2-4. In addition, the damaged state of the cutting inserts were also observed.

Moreover, the cutting inserts 1 to 35 of the invention and the comparative cutting inserts 1 to 11 were subjected to a finish turning test under the following conditions:

(B) Finish turning test

Workpiece: Steel JIS.SNCM439 (AISI4340) (hardness HB 220)

Cutting speed: 180 m/min

Feed rate: 0.2 mm/revolution

Depth of cut: 0.5 mm

Coolant: water-soluble

Cutting time: 40 min

Then, the cutting inserts were examined for width of flank wear and depth of rake surface wear. The results are set forth in Tables 2-1 to 2-4.

As will be seen from Tables 2-1 to 2-4, the cutting inserts 1 to 35 of the invention are less susceptible to separation as compared with any of the comparative cutting inserts 1 to 11, and have superior resistance to wearing and chipping.

TABLE 1

| | | Blended Composition of Material Power (weight %) | | | | | | Sintering Conditions | | |
|---|---|---|---|---|---|---|---|---|---|---|
| | | Co | TaC | (W, Ti) C | (W, Ti, Ta) C | (W, Ti) (C, N) | WC | Temperature (°C.) | Time (hr) | Atmosphere (Torr) |
| WC - Based Cemented Carbide Substrate | A | 6 | — | — | — | — | other | 1450 | 1 | 0.05 Vacuum |
| | B | 6 | 1 | — | — | — | other | 1450 | 1 | 0.05 Vacuum |
| | C | 6 | 3 | 3 | — | — | other | 1450 | 1 | 0.05 Vacuum |
| | D | 7 | 1 | — | — | — | other | 1420 | 1 | 0.05 Vacuum |
| | E | 7 | — | — | 5 | — | other | 1420 | 1 | 0.05 Vacuum |
| | F | 7 | 3 | 4 | — | — | other | 1420 | 1 | 0.05 Vacuum |
| | G | 8 | 2 | — | — | — | other | 1420 | 1 | 0.05 Vacuum |
| | H | 8 | — | — | — | — | other | 1420 | 1 | 0.05 Vacuum |
| | I | 9 | 2 | — | — | — | other | 1400 | 1 | 0.05 Vacuum |
| | J | 9 | 5 | 8 | — | — | other | 1400 | 1 | 0.05 Vacuum |
| | K | 10 | — | — | 10 | — | other | 1400 | 1 | 0.05 Vacuum |
| | L | 10 | 5 | 10 | — | — | other | 1400 | 1 | 0.05 Vacuum |
| | M | 11 | 5 | — | — | 10 | other | 1400 | 1 | 0.05 Vacuum |
| | N | 6 | 1 | — | — | — | other | 1450 | 1 | 0.05 Vacuum |
| | O | 6 | 1 | — | — | — | other | 1450 | 1 | 0.05 Vacuum |
| | P | 9 | 2 | — | — | — | other | 1450 | 1 | 0.05 Vacuum |
| | Q | 9 | 2 | — | — | — | other | 1450 | 1 | 0.05 Vacuum |
| | R | 6 | 3 | — | — | 3 | other | 1450 | 1 | 0.05 Vacuum |

| | | | Heat-treating Conditions | | |
|---|---|---|---|---|---|
| | | Grinding Method of Surface | Temperature (°C.) | Time (hr) | Atmosphere |
| WC - Based Cemented Carbide Substrate | A | Diamond Grinding | 1420 | 1 | 0.01 Torr Vacuum |
| | B | Diamond Grinding | 1420 | 1 | 0.01 Torr Vacuum |
| | C | Diamond Grinding | 1420 | 1 | 0.01 Torr Vacuum |
| | D | Diamond Grinding | 1400 | 1 | 0.01 Torr Vacuum |
| | E | Diamond Grinding | 1400 | 1 | 0.01 Torr Vacuum |
| | F | Diamond Grinding | 1400 | 1 | 0.01 Torr Vacuum |
| | G | Diamond Grinding | 1400 | 1 | 0.01 Torr Vacuum |
| | H | Diamond Grinding | 1400 | 1 | 0.01 Torr Vacuum |
| | I | Diamond Grinding | 1380 | 1 | 100 atm Ar |
| | J | Diamond Grinding | 1380 | 1 | 100 atm Ar |
| | K | Diamond Grinding | 1350 | 1 | 100 atm Ar |
| | L | Diamond Grinding | 1350 | 1 | 100 atm Ar |
| | M | Diamond Grinding | 1300 | 1 | 1 Torr $N_2$ gas |
| | N | — | — | — | — |
| | O | Diamond Grinding | — | — | — |
| | P | — | — | — | — |
| | Q | Diamond Grinding | — | — | — |
| | R | — | — | — | — |

TABLE 2

| | | Substrate | Composition of Hard Coating* and Average Thickness** of Each Layer (μm) | Substrate after Formation of Hard Coating: Co Content (wt %) Surface Portion | Co Content (wt %) Interior Portion | Co Content (wt %) Reduction in Co (%) | WC Average Grain size (μm) Surface Portion | WC Average Grain size (μm) Interior Portion | WC Average Grain size (μm) Percentage of Coarse WC | Diffraction Peaks for (2, 1, 1) Plane for WC in the Surface Portion | Cutting Tests: Milling Flank Wear Width (mm) | Milling Damaged State of Cutting | Finish Turning Flank Wear Width (mm) | Finish Turning Crater Wear Depth (μm) |
|---|---|---|---|---|---|---|---|---|---|---|---|---|---|---|
| Cutting Inserts of the Invention | 1 | A | TiC(3) | 3.9 | 6.1 | 36 | 6.0 | 4.9 | 22 | Separated | 0.24 | Fine Chipping | — | — |
| | 2 | A | TiCN(3) | 3.8 | 6.1 | 38 | 6.0 | 4.9 | 22 | Separated | 0.22 | Fine Chipping | — | — |
| | 3 | A | TiN(3) | 5.1 | 6.1 | 16 | 6.0 | 4.9 | 22 | Separated | 0.26 | Fine Chipping | — | — |
| | 4 | B | TiC(2)—TiN(1) | 4.0 | 6.1 | 34 | 5.6 | 4.8 | 17 | Separated | 0.23 | Fine Chipping | 0.24 | 20 |
| | 5 | B | TiCN(2)—TiN(1) | 3.9 | 6.1 | 36 | 5.5 | 4.8 | 15 | Separated | 0.22 | Fine Chipping | 0.25 | 15 |
| | 6 | B | TiN(2)—TiCN(1) | 5.0 | 6.1 | 18 | 5.4 | 4.8 | 13 | Separated | 0.26 | Fine Chipping | 0.28 | 15 |
| | 7 | C | TiC(2)—TiN(1) | 5.1 | 6.0 | 15 | 5.6 | 4.6 | 22 | Separated | 0.27 | Fine Chipping | — | — |
| | 8 | D | TiC(3)—TiN(1) | 4.3 | 7.1 | 39 | 4.4 | 3.9 | 13 | Separated | 0.20 | Normal Wear | — | — |
| | 9 | D | TiCN(3)—TiC(1) | 4.3 | 7.1 | 39 | 4.4 | 3.9 | 13 | Separated | 0.20 | Normal Wear | — | — |
| | 10 | D | TiN(0.5)—TiCN(3)—TiN(0.5) | 4.3 | 7.1 | 39 | 4.4 | 3.9 | 13 | Separated | 0.19 | Normal Wear | — | — |
| | 11 | E | TiC(3)—TiN(1) | 4.7 | 7.3 | 36 | 4.1 | 3.7 | 11 | Separated | 0.25 | Fine Chipping | — | — |
| | 12 | F | TiC(3)—TiN(1) | 5.5 | 7.4 | 26 | 4.5 | 3.7 | 22 | Separated | 0.24 | Fine Chipping | — | — |
| | 13 | F | TiCN(0.5)—TiC(3)—TiCN(0.5) | 5.5 | 7.4 | 26 | 4.5 | 3.7 | 22 | Separated | 0.22 | Normal Wear | — | — |
| | 14 | F | TiN(1)—TiCN(3)—TiN(1) | 5.4 | 7.4 | 27 | 4.4 | 3.7 | 19 | Separated | 0.21 | Normal Wear | — | — |
| | 15 | G | TiC(3)—TiN(1) | 4.8 | 7.4 | 35 | 3.8 | 3.4 | 12 | Separated | 0.19 | Normal Wear | — | — |
| | 16 | G | TiCN(3)—TiN(1) | 4.8 | 7.4 | 35 | 3.8 | 3.4 | 12 | Separated | 0.20 | Normal Wear | — | — |
| | 17 | G | TiCN(0.5)—TiCN(3)—TiN(0.5) | 4.7 | 7.4 | 36 | 3.8 | 3.4 | 12 | Separated | 0.18 | Normal Wear | — | — |
| | 18 | G | TiC(2)—TiN(1)—TiC(1)—TiN(1) | 4.9 | 8.0 | 39 | 3.8 | 3.4 | 12 | Separated | 0.18 | Normal Wear | — | — |
| | 19 | G | TiC(2)—TiCN(2)—TiN(1) | 4.9 | 8.1 | 40 | 3.8 | 3.4 | 12 | Separated | 0.18 | Normal Wear | — | — |
| | 20 | G | TiC(3)—TiCN(1)—$Al_2O_3$(1) | 5.0 | 8.3 | 40 | 3.8 | 3.4 | 12 | Separated | 0.26 | Fine Chipping | — | — |
| | 21 | G | TiC(3)—TiCN(1)—$Al_2O_3$(0.5)—TiN(0.5) | 5.1 | 8.4 | 39 | 3.8 | 3.4 | 12 | Separated | 0.25 | Fine Chipping | — | — |
| | 22 | H | TiC(4) | 5.2 | 8.2 | 37 | 4.0 | 3.4 | 18 | Separated | 0.24 | Fine Chipping | — | — |
| | 23 | H | TiCN(4) | 5.1 | 8.2 | 39 | 3.9 | 3.4 | 15 | Separated | 0.23 | Fine Chipping | — | — |
| | 24 | H | TiN(5) | 5.1 | 8.2 | 39 | 3.8 | 3.4 | 12 | Separated | 0.27 | Fine Chipping | — | — |
| | 25 | I | TiC(4)—TiN(1) | 5.7 | 9.2 | 38 | 3.5 | 3.0 | 17 | Separated | 0.19 | Normal Wear | — | — |
| | 26 | I | TiCN(1)—TiC(3)—TiCN(1) | 5.6 | 9.0 | 38 | 3.5 | 3.0 | 17 | Separated | 0.19 | Normal Wear | — | — |
| | 27 | I | TiN(0.5)—TiCN(4)—TiN(0.5) | 5.6 | 9.0 | 38 | 3.4 | 3.0 | 13 | Separated | 0.18 | Normal Wear | — | — |
| | 28 | I | TiC(3)—TiCN(1)—$Al_2O_3$(0.5)—TiN(0.5) | 6.0 | 9.3 | 35 | 3.5 | 3.0 | 17 | Separated | 0.24 | Fine Chipping | — | — |
| | 29 | J | TiC(2)—TiN(2) | 6.2 | 9.0 | 31 | 2.9 | 2.7 | 7 | Separated | 0.22 | Fine Chipping | — | — |
| | 30 | K | TiC(5) | 6.7 | 10.1 | 34 | 2.6 | 2.2 | 18 | Separated | 0.25 | Fine Chipping | — | — |
| | 31 | K | TiCN(6) | 6.6 | 10.1 | 35 | 2.5 | 2.2 | 14 | Separated | 0.27 | Fine Chipping | — | — |
| | 32 | K | TiN(7) | 6.5 | 10.1 | 35 | 2.5 | 2.2 | 14 | Separated | 0.29 | Fine Chipping | — | — |
| | 33 | K | TiC(3)—TiCN(2)—TiN(1) | 6.8 | 10.3 | 34 | 2.6 | 2.2 | 18 | Separated | 0.27 | Normal Wear | — | — |
| | 34 | L | TiC(4)—TiN(1) | 6.9 | 10.3 | 33 | 2.7 | 2.2 | 23 | Separated | 0.28 | Normal Wear | — | — |
| | 35 | M | TiC(4)—TiCN(2)—TiN(1) | 6.9 | 11.1 | 38 | 2.3 | 1.8 | 28 | Separated | 0.29 | Fine Chipping | — | — |
| Comparative Cutting Inserts | 1 | N | TiC(2)—TiN(1) | 5.7 | 6.1 | 7 | 5.0 | 4.8 | 4 | Slightly Separated | — | Breakage | 0.45 | 50 |
| | 2 | N | TiCN(2)—TiN(1) | 5.7 | 6.1 | 7 | 4.9 | 4.8 | 2 | Slightly Separated | — | Breakage | 0.47 | 50 |
| | 3 | N | TiN(2)—TiCN(1) | 5.3 | 6.1 | 5 | 4.9 | 4.8 | 2 | Slightly Separated | — | Breakage | 0.50 | 50 |
| | 4 | O | TiC(2)—TiN(1) | 6.1 | 6.1 | 0 | 4.8 | 4.8 | 0 | Not Separated | 0.62 | Chipping | — | — |
| | 5 | O | TiCN(2)—TiN(1) | 6.1 | 6.1 | 0 | 4.8 | 4.8 | 0 | Not Separated | 0.61 | Chipping | — | — |

TABLE 2-continued

| | Substrate | Composition of Hard Coating* and Average Thickness** of Each Layer (μm) | Substrate after Formation of Hard Coating: Co Content (wt %) Surface Portion | Co Content (wt %) Interior Portion | Co Content (wt %) Reduction in Co (%) | WC Average Grain size (μm) Surface Portion | WC Average Grain size (μm) Interior Portion | Percentage of Coarse WC | Diffraction Peaks for (2, 1, 1) Plane for WC in the Surface Portion | Cutting Tests: Milling Flank Wear Width (mm) | Milling Damaged State of Cutting | Finish Turning Flank Wear Width (mm) | Finish Turning Crater Wear Depth (μm) |
|---|---|---|---|---|---|---|---|---|---|---|---|---|---|
| 6 | O | TiN(2)—TiCN(1) | 6.1 | 6.1 | 0 | 4.8 | 4.8 | 0 | Not Separated | 0.69 | Chipping | — | — |
| 7 | P | TiC(2)—TiCN(1)—TiN(1) | 8.5 | 9.0 | 6 | 3.2 | 3.0 | 7 | Slightly Separated | 0.49 | Chipping | — | — |
| 8 | Q | TiC(4)—TiN(1) | 9.2 | 9.2 | 0 | 3.0 | 3.0 | 0 | Not Separated | 0.45 | Chipping | — | — |
| 9 | R | TiC(2)—TiN(1) | 9.3 | 5.9 | −58 | 5.6 | 4.6 | 22 | Slightly Separated | 0.63 | Abnormal Wear | 0.56 | 70 |
| 10 | R | TiC(2)—TiCN(1)—TiN(1) | 9.3 | 5.9 | −58 | 5.6 | 4.6 | 22 | Slightly Separated | 0.62 | Abnormal Wear | 0.56 | 70 |
| 11 | R | TiC(2)—TiCN(1)—$Al_2O_3$(1) | 9.3 | 5.9 | −58 | 5.6 | 4.6 | 22 | Slightly Separated | 0.60 | Abnormal Wear | 0.54 | 60 |

*In the case of multiple layers, 1st layer is shown on the left
**Thickness is shown in parenthesis

What is claimed is:

1. A surface-coated tool member of tungsten carbide based cemented carbide having a tungsten carbide based cemented carbide substrate containing cobalt and a hard coating formed on said substrate, wherein the cobalt content of said substrate at a surface portion at a depth of about 2 μm from a surface thereof is less than that at an interior portion at a depth of about 100 μm from said substrate by at least 10%, said surface portion of said substrate having a recrystallized structure exhibiting two X-ray diffraction peaks $K\alpha_1$ and $K\alpha_2$ indexed by index of plane (2,1,1) for tungsten carbide.

2. A tool member as recited in claim 1, wherein said hard coating comprises one or more layers each composed of one material selected from the group consisting of carbide, nitride and oxide of metals in groups $IV_A$, $V_A$ and $VI_A$ of the Periodic Table; solid solution of said carbide, nitride and oxide; and aluminum oxide.

3. A tool member as recited in claim 1, wherein the average grain size of the tungsten carbide contained at said surface portion of said substrate is greater than that of the tungsten carbide contained at said interior portion by at least 10%.

4. A tool member as recited in claim 3, wherein said hard coating comprises a first layer composed of one titanium compound selected from the group consisting of titanium carbide, titanium nitride and titanium carbonitride.

5. A tool member as recited in claim 3, wherein said hard coating has a great X-ray diffraction peak indexed by index of plane (1, 1, 1) for said titanium compound.

6. A surface coated tool member of tungsten carbide based cemented carbide according to claim 1, produced by the steps of:

a. preparing a tungsten carbide based cemented carbide substrate by conventional means;

b. grinding said substrate to impart stress to tungsten carbide grains near the surface of said substrate and to partly crush the tungsten carbide grains into smaller grains;

c. heat-treating said cemented carbide at a temperature of no less than the WC-Co eutectic temperature to recrystallize the tungsten grains, whereby the surface portion is recrystallized so as to exhibit said two diffraction peaks; and d. forming a hard coating on said substrate by chemical vapor deposition.

* * * * *

UNITED STATES PATENT AND TRADEMARK OFFICE

CERTIFICATE OF CORRECTION

PATENT NO. : 5,066,553

DATED : November 19, 1991

INVENTOR(S) : Hironori Yoshimura, et al.

It is certified that error appears in the above-identified patent and that said Letters Patent is hereby corrected as shown below:

Column 1, line 19: "IVA, VA and VIA" should read as --$IV_A$, $V_A$ and $VI_A$--

Column 3, line 45: "wit" should read as --with--

Column 4, line 35: "t" should read as --to--

Column 4, between lines 42 & 43 insert the following: --Time constant: 5 seconds--

Column 4, lines 44-45: "the separated" should read as --the diffraction peaks of index of plane (2, 1, 1) for WC are separated--

Signed and Sealed this

Fourth Day of May, 1993

*Attest:*

Michael K. Kirk

MICHAEL K. KIRK

*Attesting Officer*

*Acting Commissioner of Patents and Trademarks*